US010010803B1

(12) United States Patent
Reynolds et al.

(10) Patent No.: US 10,010,803 B1
(45) Date of Patent: Jul. 3, 2018

(54) ASSEMBLER FOR CONSTRUCTION TOY ELEMENTS

(71) Applicant: SPIN MASTER LTD., Toronto (CA)

(72) Inventors: Paul Andrew Reynolds, Toronto (CA); Hamid R. Hashemi, Mississauga (CA)

(73) Assignee: SPIN MASTER LTD., Toronto (CA)

( * ) Notice: Subject to any disclaimer, the term of this patent is extended or adjusted under 35 U.S.C. 154(b) by 0 days.

(21) Appl. No.: 15/669,558

(22) Filed: Aug. 4, 2017

(51) Int. Cl.
*A63H 33/04* (2006.01)

(52) U.S. Cl.
CPC ..... *A63H 33/048* (2013.01)

(58) Field of Classification Search
CPC ..... A63H 33/04; A63H 33/048; A63H 33/06; A63H 33/08
See application file for complete search history.

(56) References Cited

U.S. PATENT DOCUMENTS 3,849,912 A * 11/1974 Kemnitzer ..... G09B 19/00 434/98
3,921,330 A * 11/1975 Drieze ..... A63F 9/06 273/157 R
5,174,757 A * 12/1992 Jones ..... G09B 1/10 428/542.2
9,506,485 B2 11/2016 Gershenfeld et al.
9,636,601 B2 5/2017 Reynolds
2017/0036136 A1 2/2017 Chazen

* cited by examiner

*Primary Examiner* — John Ricci
(74) *Attorney, Agent, or Firm* — Millman IP Inc.

(57) ABSTRACT

An assembler for construction toy elements is provided. Each construction toy element has a plurality of arms extending from a body, wherein each arm includes a root end projecting from the body and a free end having a first connecting member thereon that is configured for connecting the construction toy element to another construction toy element. The assembler includes an alignment receptacle having a set of alignment structures defining positions along the alignment receptacle, each of the alignment structures receiving at least one of the construction toy elements and inhibiting movement thereof to other positions along the alignment receptacle. The assembler also includes a set of element conduits, each of the element conduits having a receiving opening securely receiving the at least one of the construction toy elements from a corresponding one of the positions along the alignment receptacle. Further, the assembler includes a motion alignment structure controlling relative movement of the set of element conduits and the alignment receptacle between a first pose, in which the receiving openings of the element conduits are spaced from the alignment receptacle, and a second pose, in which each of the receiving openings of the element conduits are situated adjacent a corresponding one of the positions of the alignment receptacle to securely receive the at least one construction toy element located at the corresponding one position.

17 Claims, 15 Drawing Sheets

ASSEMBLER FOR CONSTRUCTION TOY ELEMENTS

FIELD

This disclosure relates generally to the field of construction toy sets and more particularly to assemblers for construction toy elements.

BACKGROUND OF THE DISCLOSURE

Construction toy sets are well known and typically comprise a set of construction toy elements that are connectable together to form a structure. It is common in the field of construction toy sets to share build instructions in order to facilitate the reproduction of a particular construction toy structure with a certain appearance. Such build instructions may be provided with particular sets of construction toy elements but they may also be shared publicly via the Internet.

Current approaches for assembly of such construction toy structures suffer from several drawbacks. Construction toy structures are typically relatively slow to create since the construction toy elements are usually assembled one-by-one. This process can be greatly slowed down where the construction toy elements are being arranged together in a certain manner to form a particular structure. This is especially true where the construction toy elements are colored and their ordered placement within the particular structure matters to give the construction toy structure a certain appearance. If the manner in which the construction toy elements are connectable to one another allows for variable spacing between them, it can be still yet more difficult to achieve a desired construction toy structure with the certain appearance.

There is consequently a need for new approaches for assembling construction toy structures that overcomes one or more of these problems, while still being inexpensive to produce.

SUMMARY OF THE DISCLOSURE

In one aspect, there is provided an assembler for construction toy structures assembled from construction toy elements, each construction toy element having a plurality of arms extending from a body, wherein each arm includes a root end projecting from the body and a free end having a first connecting member thereon that is configured for connecting the construction toy element to another construction toy element, comprising an alignment receptacle having a set of alignment structures defining positions along the alignment receptacle, each of the alignment structures receiving at least one of the construction toy elements and inhibiting movement thereof to other positions along the alignment receptacle, a set of element conduits, each of the element conduits having a receiving opening securely receiving the at least one of the construction toy elements from a corresponding one of the positions along the alignment receptacle, and a motion alignment structure controlling relative movement of the set of element conduits and the alignment receptacle between a first pose, in which the receiving openings of the element conduits are spaced from the alignment receptacle, and a second pose, in which each of the receiving openings of the element conduits are situated adjacent a corresponding one of the positions of the alignment receptacle to securely receive the at least one construction toy element located at the corresponding one position.

The alignment receptacle can be generally planar.

The body of each construction toy element can comprise a receiving aperture, and each of the alignment structures can comprise a mounting projection dimensioned to slidingly fit within the aperture.

The alignment structures can comprise separation structures preventing contact between the first connecting member of one of the construction toy elements placed in one of the positions from contacting the first connecting member of another of the construction toy elements placed in an adjacent one of the positions. The separation structures can comprise walls between the positions.

Each of the set of element conduits can have a passageway extending from the receiving opening to an output opening.

The output openings of adjacent element conduits can be proximate one another so that the first connecting members of a first of the construction toy elements exiting one output opening can engage the first connecting members of an adjacent one of the output openings.

A first of the passageways can taper from the receiving opening to the output opening.

A second of the passageways can be non-linear and veer towards the first passageway proximal to the output opening thereof.

The side wall of a third of the passageways can extend downstream of the output opening of the second passageway and slope towards a central axis of the first passageway.

A first of the passageways can be non-linear and veer towards a second of the passageways proximal to the output opening thereof.

The side wall of a third of the passageways can extend downstream of the output opening of the first passageway and slope towards a central axis of the second passageway.

The assembler can further comprise a connected set of plungers insertable between the alignment receptacle and the set of element conduits, the plungers being dimensioned to at least partially travel into the element conduits when the set of element conduits and the alignment receptacle are moved relative to one another towards the second pose. The passageway of at least one of the element conduits can be non-linear, and at least one of the plungers corresponding to the at least one element conduit with the non-linear passageway can be suitably flexible to travel through the passageways of the at least one element conduit.

The passageways adjacent the receiving openings can be smaller in width than a span of the arms of the construction toy elements so that the arms of the construction toy elements hold the construction toy elements within the passageways.

The element conduits can comprise engagement features within the passageways of the element conduits engaging the arms of the construction toy elements placed therein. The engagement features can inhibit travel of the construction toy elements positioned within the passageways towards the receiving openings.

BRIEF DESCRIPTIONS OF THE DRAWINGS

For a better understanding of the embodiment described herein and to show more clearly how they may be carried into effect, reference will now be made, by way of example only, to the accompanying drawings in which.

DETAILED DESCRIPTION

Figure 1:
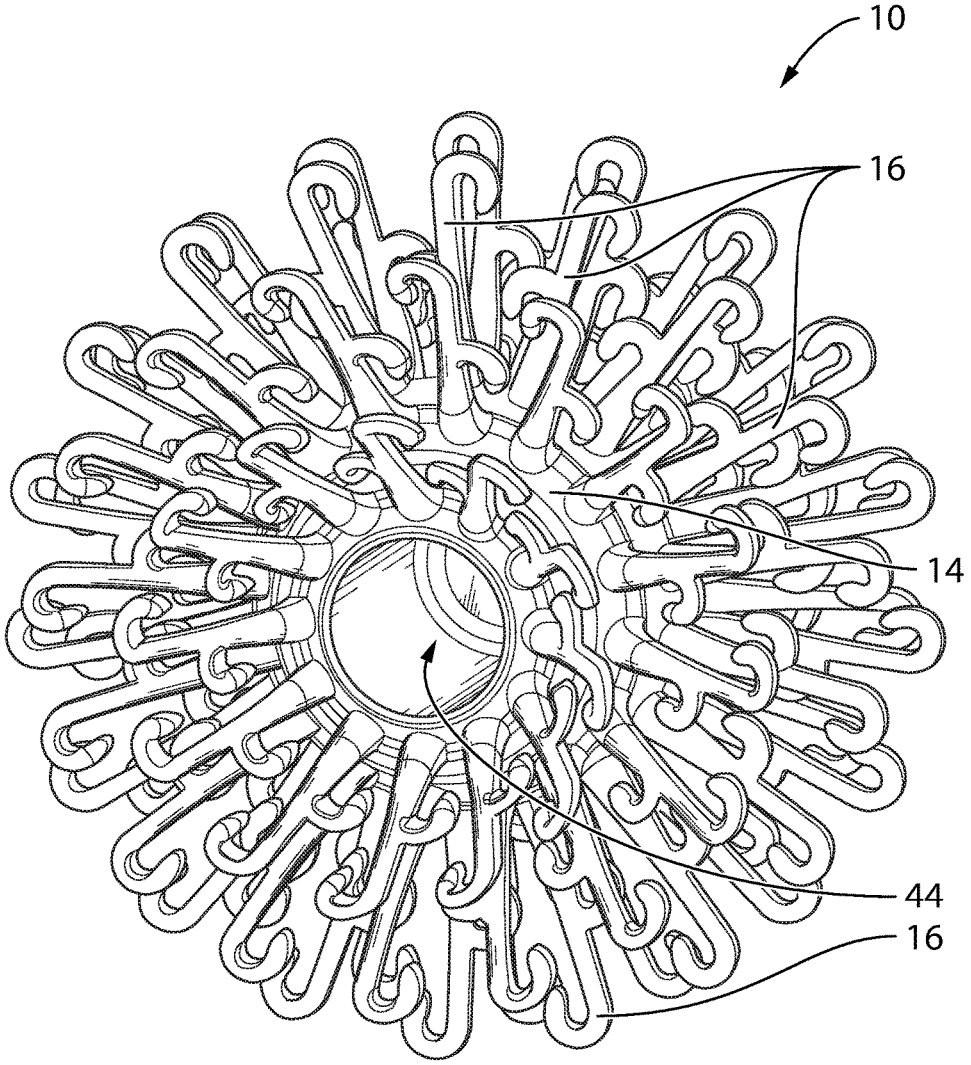
FIG. 1 is a perspective view of a construction toy element in accordance with an embodiment, including a body and arms that extend from the body.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Figure 2:
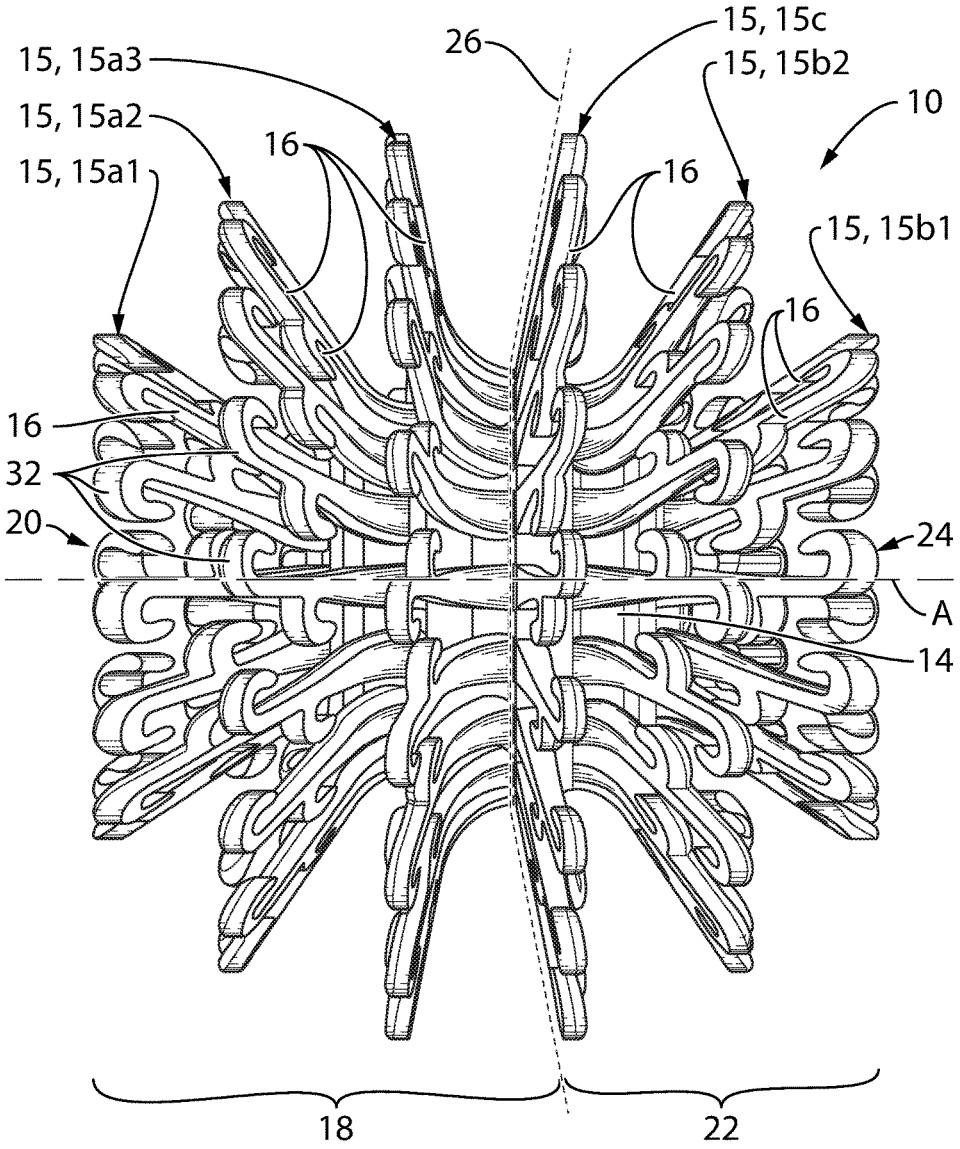
FIG. 2 is a side elevation view of the construction toy element shown in FIG. 1.

Reference is made to FIGS. 1 and 2, which show a construction toy element 10 for use as part of a construction toy set 12 that contains a plurality of the construction toy elements 10, in accordance with an embodiment of the invention.

The construction toy element 10 (which may, for convenience be referred to simply as element 10) includes a body 14 and a plurality of rows 15 (FIG. 2) of arms 16 extending from the body 14.

Referring to FIG. 2, the body 14 has an axis A, and has a first axial portion 18 on which there is a first axial end 20 and a second axial portion 22 on which there is a second axial end 24. The first and second axial portions 18 and 22 meet at a boundary 26, described further below.

The plurality of rows 15 of arms 16 as shown in FIG. 2 include first, second and third rows 15*a*1, 15*a*2 and 15*a*3 on the first axial body portion 18, first and second rows 15*b*1 and 15*b*2 on the second axial body portion 22, and a boundary row 15*c* that is on the boundary 26.

Figure 3:
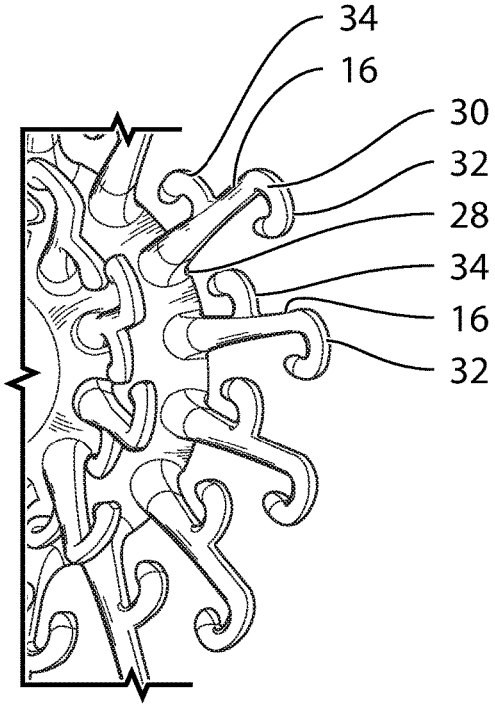
FIG. 3 is a magnified perspective view of a portion of the construction toy element in FIG. 1, showing the structure of some of the arms.
Figure 5:
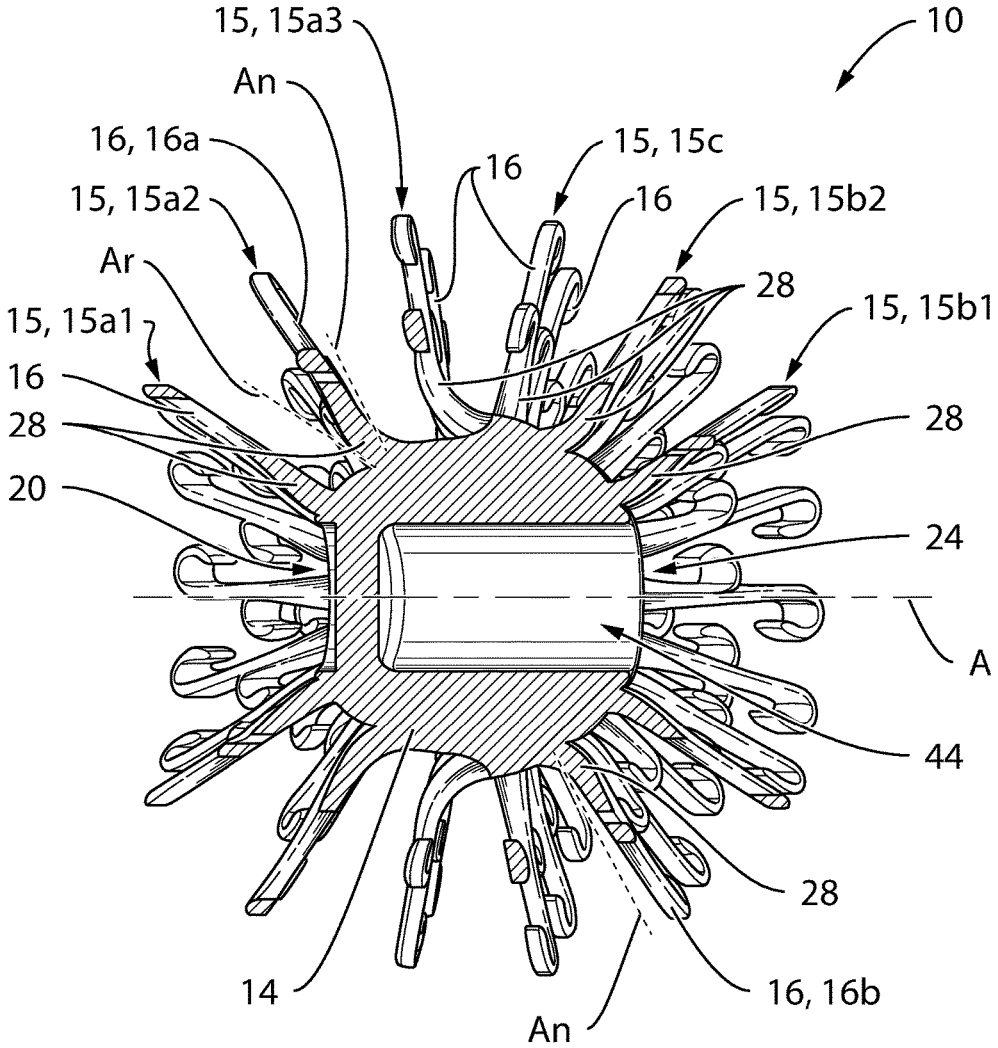
FIG. 5 is a sectional side elevation view of the construction toy element shown in FIG. 1.
Figure 6:
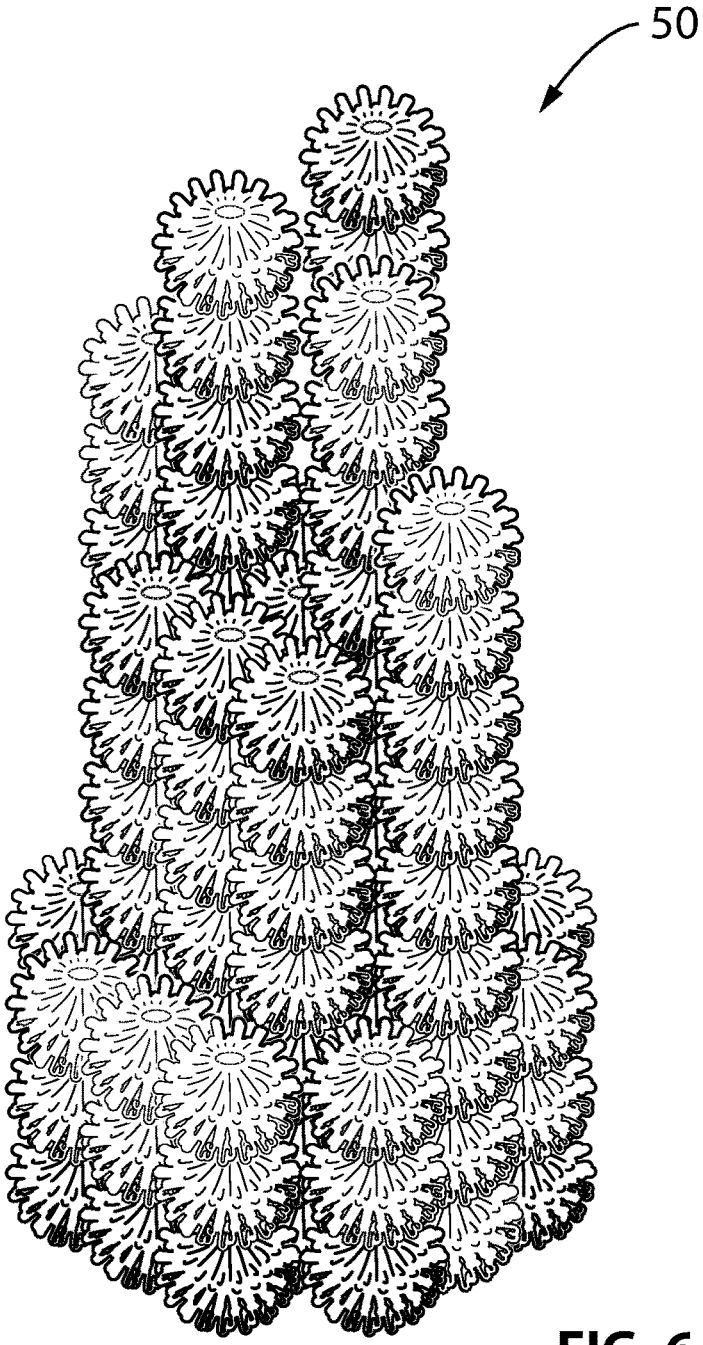
FIG. 6 is a perspective view of a structure assembled from a plurality of the construction toy elements shown in FIG. 1.

Referring to FIG. 3, each arm 16 includes a root end 28 and a free end 30, and has first and second connecting members 32 and 34 thereon that are configured for connecting the construction toy element 10 to similar connecting members on another construction toy element 10 (as shown, for example, in FIG. 6 at 50). Referring to FIG. 5, the root end 28 may project from the body 14 in a direction that is angled towards one of the first and second axial ends 20 and 24 relative to a normal direction to a surface of the body 14. A line representing a normal direction to the surface of the body is shown at An in FIGS. 4 and 5. A line representing the direction of the root end 28 is shown as Ar. As can be seen in FIG. 5, for the arm shown at 16*a*, the line Ar is angled towards the axial end 20 relative to the line An. As a result, the arm 16*a* is capable of easily flexing in a direction towards the first axial end 20. Similarly, for the arm shown at 16*b*, the line Ar is angled towards the axial end 24 relative to the line An, thereby permitting the arm 16*b* to flex easily towards the second axial end 24. A benefit to this structure is described further below in relation to the manufacture of the element 10. Referring to FIG. 5, it will be noted that each of the arms 16 in rows 15*a*1 and 15*a*3 also have root ends that are angled towards the first axial end 20 relative to locally normal directions to the surface of the body 14. It will be further noted that the arms 16 that make up the rows 15*b*1 and 15*b*2 are angled towards the second axial end 24 relative to a normal direction to a normal line to the surface of the body 14. Also, the root ends 28 of the arms 16 of the boundary row 15*c* extend generally normally from the surface of the body 14, although this does not need to be the case.

Figure 4:
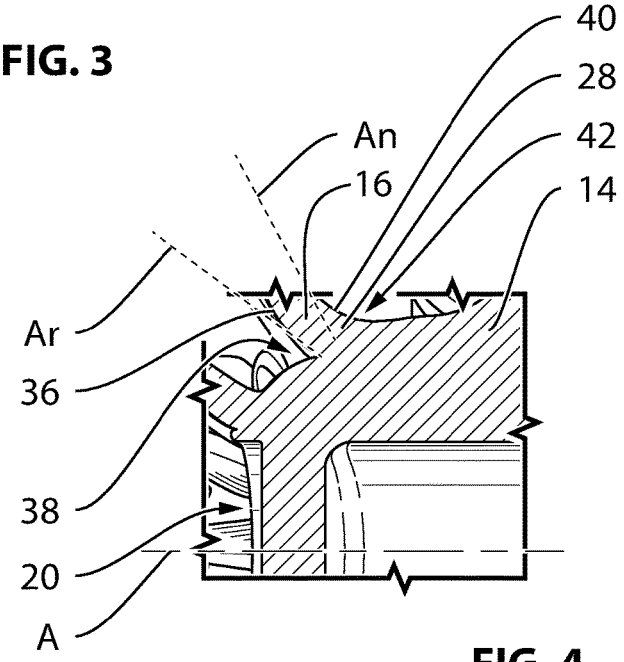
FIG. 4 is a highly magnified sectional side elevation view of a portion of the construction toy element, showing the connection between one of the arms and the body.

With reference to FIG. 4, it will also be noted that the root end 28 has a first axial side 36 that is connected to the body 14 by a first fillet 38 with a first effective radius, and has a second axial side 40 that is connected to the body 14 by a second fillet 42 with a second effective radius that is larger than the first effective radius. This facilitates the bending of the arm 16 towards the first axial side 36 under circumstances in which it is needed, as is described further below.

Each of the connecting members 32 and 34 may be a hook, as shown in FIG. 3. Thus, in respect of the embodiment illustrated in FIGS. 1 to 5, connecting members 32 may be described interchangeably as hooks 32. As can be seen in FIG. 2, the hooks 32 in each row 15 all may be oriented in the same direction, and the hooks 32 in each adjacent row 15 may be oriented in the opposite direction. Thus, the first hooks 32 on all the arms 16 of the first circumferential row 15*a*1 face in a first circumferential direction, and the first hooks 32 of the second circumferential row 15*a*2, which is adjacent the first circumferential row 15*a*1 face in a second circumferential direction that is opposite the first circumferential direction. This may help the element 10 connect to adjacent elements 10 during assembly of a toy. The first hook 32 is shown at the free end 30 of each arm 16, whereas the second hook 34 is shown at an intermediate point on each arm 16, and is oriented in the opposite direction to the first hook 32.

By providing a hook (i.e., hook 32) on the end of the arm 16 and a hook (i.e., hook 34) on an intermediate portion of the arm 16 (i.e. intermediate the free end 30 and the root end 28), the element 10 is provided with more opportunities to connect to an adjacent element 10 when the two elements 10 are brought together. Furthermore, connections can be made between the hooks 32 on an arm on one element 10 with the hooks 34 on the arm of an adjacent element 10, while the hooks 32 on the other element 10 can connect with the hooks 34 on the first element 10, thereby strengthening the connection. Additionally, because the bodies 14 of the elements 10 are generally spherical, when two elements 10 are brought into proximity of one another, they are nearest each other in one spot and the surfaces of the bodies 14 are further and further spaced from each other due to the generally spherical curvature of the bodies 14. By providing connecting members both at the free ends 30 and intermediate the free ends 30 and the root ends 28, one can obtain connections between hooks 32 on one element 10 and the hooks 34 on the other element 10 in the region where the bodies 14 are closest to each other, and connections between hooks 32 on one element 10 and hooks 32 on the other element 10, thereby increasing the possible number of connections that are formed between two adjacent elements. It will further be noted that the spacing between the arms 16 in each row also facilitates bringing the bodies 14 of two adjacent elements 10 closer together. If the density of the arms 16 was so high that the root ends 28 of the arms 16 were immediately adjacent on another on each element 10, then there would not be space for an arm 16 from another element 10 to be inserted between them. By spacing the arms 16 at least sufficiently to receive the free end 30 of an arm 16 from an adjacent element 10 there is a greater probability of generating a connection between the intermediate hooks 34 on the arms 16 of the two elements 10.

As can be seen in FIGS. 1 and 5, the element 10 has a receiving aperture 44 that is configured to receive a mounting projection. The receiving aperture 44 also serves to reduce the overall amount of material that is needed to form the element 10, which results in a lower cost for the element 10.

It will be observed in FIG. 2 that the axial side of each arm 16 that faces towards the associated axial end of the element 10 is rounded in profile, but that the opposing axial side of the arm 16 has a flat profile.

In the embodiment shown in FIGS. 1 to 6, the construction toy element 10 had 6 rows of arms. It will be understood that the element 10 could alternatively have any other suitable number of rows of elements. For example, the element 10 could have five rows of arms 16. Further, while each arm 16 has two hooks, in other variations, the arms can have one hook, or three or more hooks.

Materials that can be used for the element 10 may be any suitably soft flexible material. Some examples include EVA (ethylene-vinyl acetate), PP (polypropylene), PE (polyethylene), or suitable mixtures thereof.

It has been found that the element 10 is advantageous in that it does not need to be assembled into a structure one element 10 at a time. Instead, it can be assembled into a structure en masse by forming a substructure (e.g., a layer or a chain) of many elements, coupling it to another substructure of many elements, and repeating the process until the structure is complete.

Figure 7:
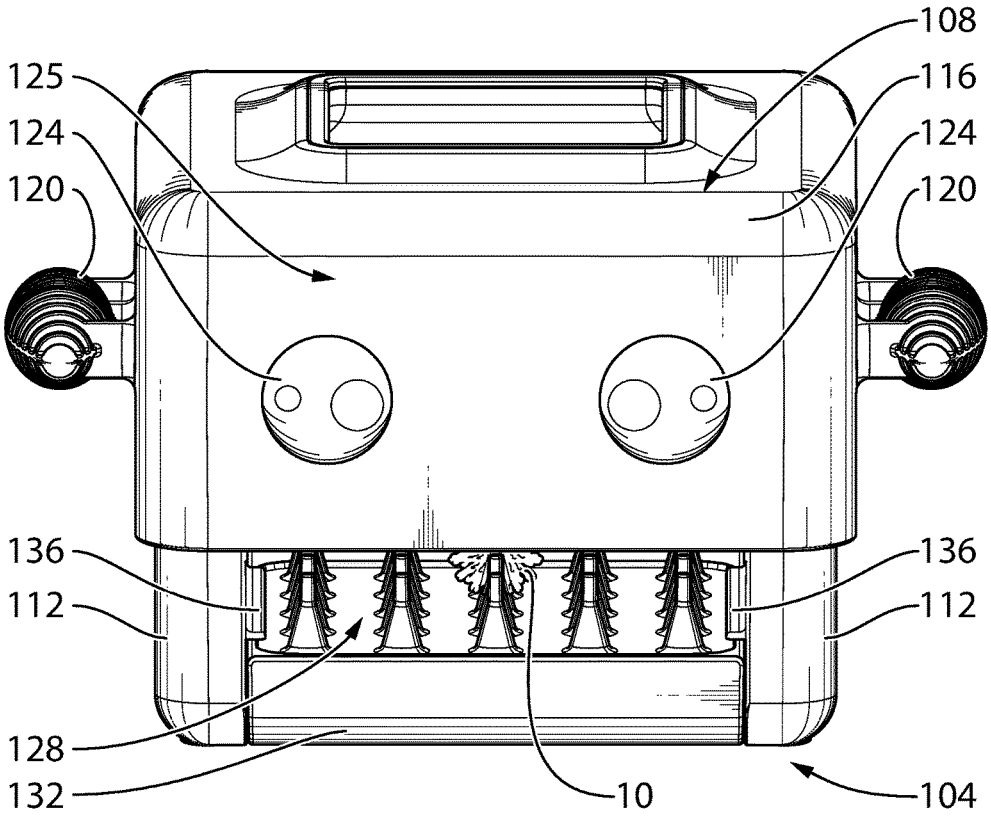
FIG. 7 is a front view of an assembler for construction toy structures assembled from construction toy elements in accordance with an embodiment.

FIG. 7 shows a front view of an assembler 100 for assembling construction toy elements into construction toy structures.

The assembler 100 has an assembler base structure 104 and an assembler cap structure 108 that is coupled to the assembler base structure 104. For purposes of this discussion, it will be assumed that the assembler 100 will be used in the orientation in which it is presented in FIG. 7 with the assembler cap structure 108 positioned above the assembler base structure 104, and relative and absolute directions and positions may be described relative to this orientation. The assembler base structure 104 includes two side walls 112 and a rear wall, but has no front wall. The assembler cap structure 108 includes a crown 116 that has a handle 120 on each side thereof. A pair of decorative disks 124 painted or otherwise decorated to make them appear as eyes are positioned on an outer surface of a front wall 125 of the crown 116. The absence of a front wall in the assembler base structure 104 provides a front-facing opening 128 in the assembler 100.

An alignment receptacle in the form of an alignment tray 132 is positioned within the assembler base structure 104. The alignment tray 132 is inserted into and withdrawn from a slot created via a set of tray guides 136 projecting from an inside surface of the side walls 112.

Figure 8:
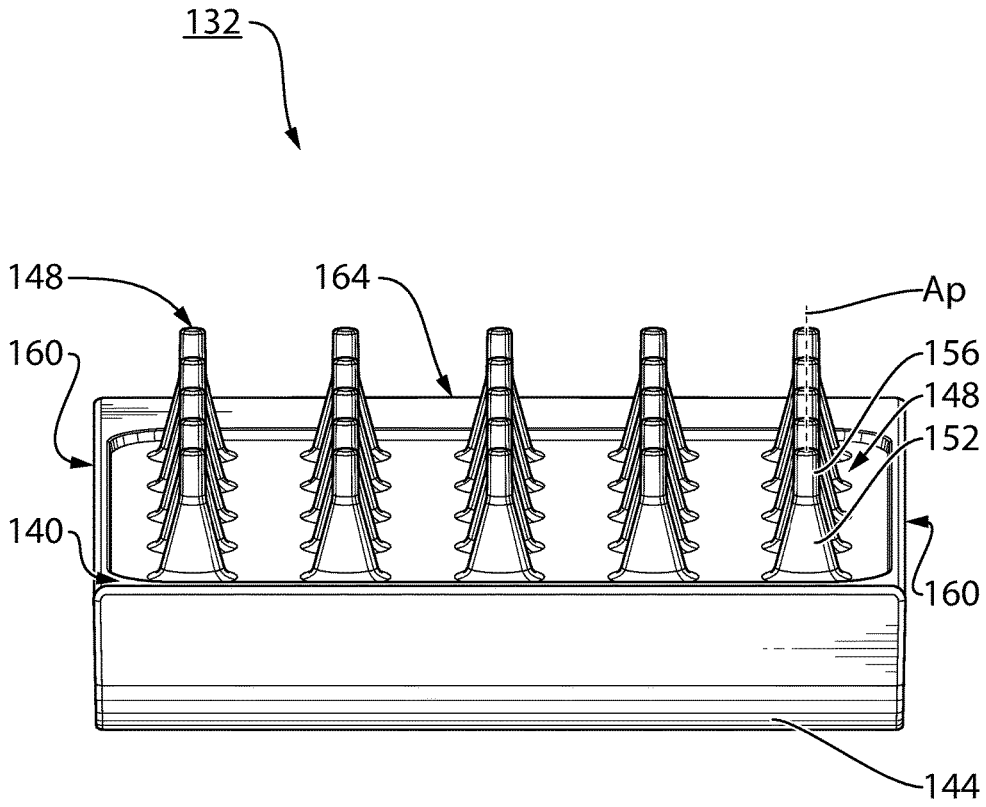
FIG. 8 is a front perspective view of an alignment tray of the assembler of FIG. 7.

FIG. 8 shows the alignment tray 136 in isolation. The alignment tray 136 has a base plate 140 that has a tray chin 144 that provides a grip to facilitate insertion and withdrawal of the alignment tray 136 within the assembler base structure 104. A set of mounting projections 148 extend upwardly from the base plate 140. The mounting projections 148 act as alignment structures that define positions along the alignment tray 136. Each of the mounting projections 148 has a frustoconical base 152 that tapers to a mounting post 156 that is sized to be received within the receiving aperture 44 of a construction toy element 10. The frustoconical base 152 spaces the mounting post 156 from the base plate 140 so that the arms 16 of the construction toy element 10 either do not contact the base plate 140 or only contact the base plate 140 slightly so that they do not urge the construction toy element 10 off of the mounting post 156. The mounting post 156 has a generally cylindrical profile, and has a central projection axis A. The cylindrical shape of the mounting post 156 facilitates the linear placement and removal of one of the construction toy elements 10 along the axis $A_T$, but restricts lateral movement of the construction toy element 10 once the mounting post 156 is positioned within the receiving aperture 44 of the construction toy element 10.

Referring now to FIGS. 1 and 8, each mounting projection 148 defines a position along the alignment tray 136. In particular, the mounting projections 148 are arranged in a grid of five rows and five columns. Each mounting projection 148 is sufficiently spaced apart from adjacent mounting projections 148 so that the hooks 32 on the arms 16 of a construction toy element 10 mounted thereon are unlikely to engage the hooks 32 of the construction toy elements 10 mounted on the adjacent mounting projections 148, either as a result of being out of range or not being in sufficient range to enable engagement of the hooks 32 of adjacent construction toy elements 10.

Further, referring to FIGS. 1, 7, and 8, the mounting projections 148 are sufficiently spaced from the side edges 160 and the rear edge 164 of the base plate 140 so that contact, if any, between the arms 16 of construction toy elements 10 mounted on the mounting projections 148 and the interior surface of the side walls 112 and the rear wall of the assembler base structure 104.

Figure 9:
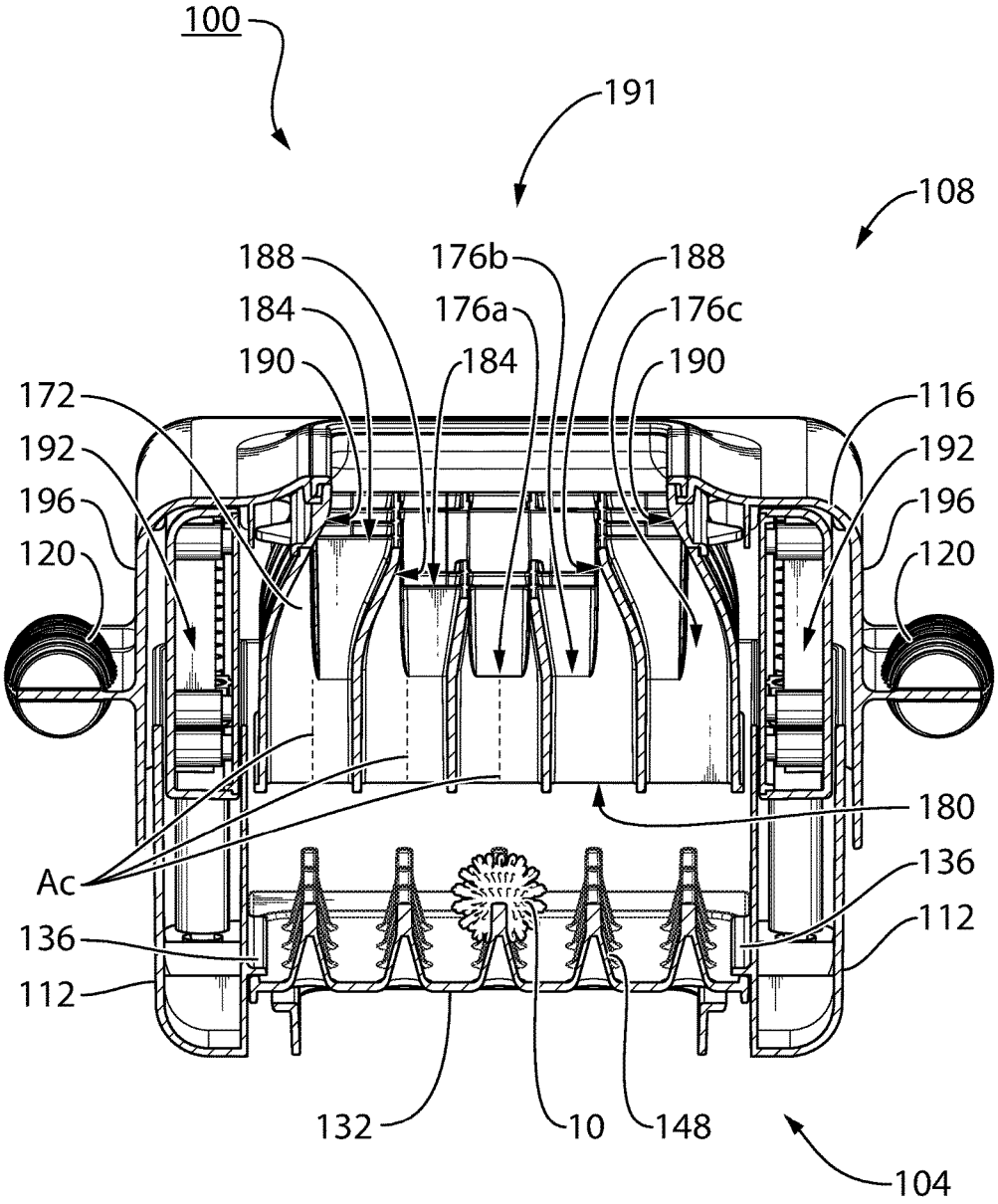
FIG. 9 is a front section view of the assembler of FIG. 7.

FIG. 9 shows a section view of the assembler 100, illustrates that the assembler cap structure 108 includes a set of element conduits 172 located centrally therein. The set of element conduits 172 is a molded plastic part that has a set of passageways 176 that have central passageway axes $A_C$ that are generally parallel to and aligned with the central projection axes $A_P$ of the mounting posts 156. Each of the passageways 176 of the set of element conduits 172 has a receiving opening 180 positioned close to a corresponding mounting projection 148, and an output opening 184 at the other end of the passageways 176.

As there are five rows by five columns of mounting projections 184, and as there is a corresponding passageway 176 for each mounting projection 184, there are five rows and five columns of passageways 176. As shown, a central passageway 176*a* tapers from its receiving opening 180 to its output opening 184. As a result, the arms 16 of a construction toy element 10 travelling through the passageway 176*a* thereof are compressed/bent.

The eight immediately adjacent passageways 176*b* follow a somewhat non-linear path and veer towards the central passageway 176*a* proximal to the output openings 184, as do the 16 outer passageways 176*c*. As construction toy elements 10 in the output openings 184 of the passageways 176 immediately adjacent the central passageway 176*a* exit, they are travelling on a path towards construction toy elements 10 exiting the central passageway 176*a*, and urged along this path by other construction toy elements 10 in the same passageways 176.

The central and immediately adjacent passageways 176 terminate at output openings 184 that are upstream (i.e., counter to the operational travel direction of construction toy elements 10 from the receiving openings 180 to the output openings 184 of the passageways 176, or closer to the receiving openings 180) of the output openings 184 of the subsequently adjacent passageways 176, such as passageway 176*c*. Side walls 188 of the subsequently adjacent passageways 176 slope inwards towards the central axis $A_C$ of the central passageway 176*a* to further urge the construction toy elements 10 exiting the immediately adjacent passageways 176 into contact with the construction toy elements 10 exiting the central passageway 176*a*. As the construction toy elements 10 exiting the central passageway 176*a* exit the output opening 184 thereof, their resilient arms 16 are no longer constricted and expand/extend outwards, causing the hooks 32 thereof to engage hooks 32 on the arms 16 of those construction toy elements 10 exiting the immediately adjacent passageways 176 that are being urged towards them.

As a result, the construction toy elements 10 from the central and immediately adjacent passageways 176 engage each other prior to being exposed to the construction toy elements 10 exiting the downstream (i.e., in the operational travel direction of construction toy elements 10 from the receiving openings 180 to the output openings 184 of the passageways 176) output openings 184 of the subsequently adjacent (that is, the outermost in this embodiment) passageways 176. This allows a core of the structure of construction toy elements 10 to bind first.

Further, as the construction toy elements 10 exiting the output openings 184 of the subsequently adjacent passageways 176, such as passageway 176*c*, they are travelling on a path towards construction toy elements 10 exiting the central passageway 176*a* and the immediately adjacent passageways 176, and urged along this path by other construction toy elements 10 in the same passageways 176. Further, side walls 190 of a central aperture 191 in a top surface of the crown 116 slope inwards towards the central axis $A_C$ of the central passageway 176*a* to further urge the construction toy elements 10 exiting the subsequently adjacent passageways 176 into contact with the construction toy elements 10 exiting the central passageway 176*a* and the immediately adjacent passageways 176 to engage and bind with them via their hooks 32.

The central aperture 168 of the crown 116 enables construction toy elements 10 exiting the passageways 176 to exit the top of the assembler 100.

The side walls 112 of the assembly base structure 104 nest releasably within cavities 192 of side walls 196 of the crown 116, such that the assembler cap structure 108 can be entirely separated from the assembler base structure 104. A back panel of the crown 116 overlaps the back wall of the assembler base structure 104. The cavities 192 are dimensioned to receive the side walls 112 of the assembler base structure 104, enabling the assembler cap structure 108 to slide down atop of the assembler base structure 104.

Metal helical coil springs extend through and upwardly out of vertically aligned tubes in the side walls 112 of the assembler base structure 104 to engage a top inside surface of the crown 116 to thereby biases the assembler cap structure 108 upwards and away from the assembler base structure 104.

The arrangement of the side walls 112 of the assembler base structure 104 nesting within the side walls 172 of the assembler cap structure 108, together with the biasing forces of the helical coil springs, acts as a motion alignment structure coupled to the alignment tray 136 and the set of element conduits 172 controlling relative movement of the set of element conduits 172 and the alignment tray 136 between a first pose, in which the receiving openings 180 of the passageways 176 are spaced from the alignment tray 136, and a second pose, in which each of the receiving openings 180 of the passageways 176 are situated adjacent a corresponding one of the positions of the alignment tray 136 to securely receive the at least one construction toy element 10 located at the corresponding position.

The assembler cap structure 108 can be urged from the first pose to the second pose by pushing down on the assembler cap structure 108, such as via the handles 120. When the assembler cap structure 108 is in the second pose, the walls of the passageways 176 envelop the construction toy elements 10 mounted on the mounting posts 156. The passageways 176 of the set of element conduits 172 adjacent the receiving openings 180 are smaller in width than a span of the arms 16 of the construction toy elements 10 so that the arms 16 of the construction toy elements 10 hold the construction toy elements 10 within the passageways 176. As the downward pressure applied by a person on the assembler cap structure 108 is reduced, the assembler cap structure 108 is allowed to be urged upwards by the biasing force of the metal helical coil springs disposed between the assembler cap structure 108 and the assembler base structure 104. As the assembler cap structure 108 travels upwards, the construction toy elements 10 that were previously mounted on the mounting projections 148 and are now held within the passageways 176 are picked up off of the mounting projections 148.

Figure 10:
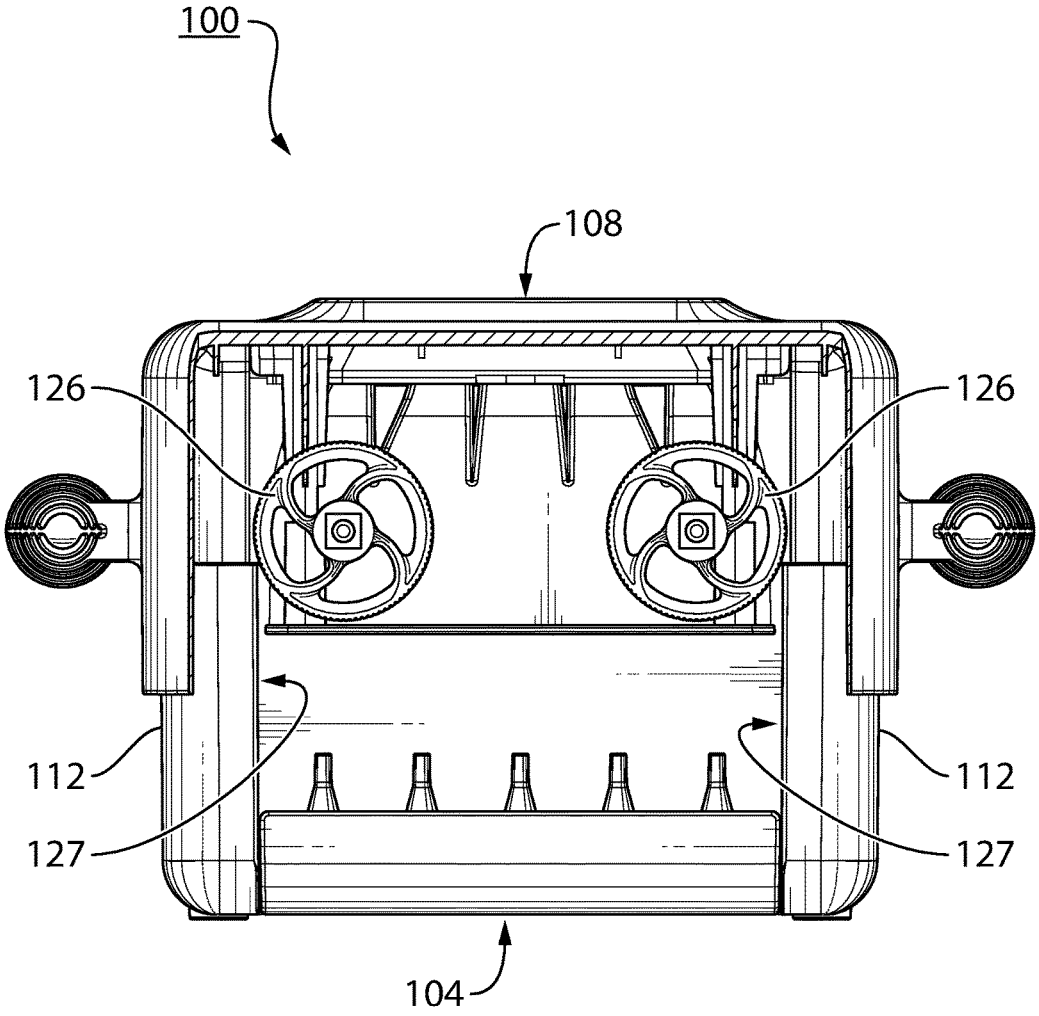
FIG. 10 is another front section view of the assembler of FIG. 7.

FIG. 10 shows mechanisms for rotating the decorative disks 124 of the assembler cap structure 108. The decorative disks 124 are coupled to gears 126 on an opposite surface of the front wall 125 of the crown 116 via posts that pass through holes in the front wall 125. The decorative disks 124 and the coupled gears 126 freely rotate relative to the front wall 125 of the assembler cap structure 108. When the assembler cap structure 108 and the assembler base structure 104 are moved relative to one another between the first pose and the second pose, the gears 126 are engaged by toothed strips 127 along the interior surface of the side walls 112 of the assembler base structure 104, causing the gears 126 and the decorative disks 124 to rotate. As a result, the eyes depicted on the decorative disks 124 appear to rotate.

Referring again to FIGS. 7 to 9, upon picking up a first set of construction toy elements 10 from the alignment tray 132, mounting of a second set of construction toy elements 10 atop of the mounting projections 148, and movement of the assembler cap structure 108 to the second pose, any previously picked up construction toy elements 10 in a passageway 176 are pushed into contact with any construction toy elements 10 mounted on the corresponding mounting projection 148, causing some of the hooks 32 on the arms 16 of the construction toy elements 10 to engage each other, thereby coupling the construction toy elements 10 together to form a chain of construction toy elements 10. Further, the somewhat rigid arms 16 space construction toy elements 10 in a passageway 176 apart. As a result, previously picked up construction toy elements 10 in a passageway 176 are urged upwards when the assembler cap structure 108 is moved to the second pose and a new construction toy element 10 enters the passageway 176.

In order to build a structure with the construction toy elements 10 via the assembler 100, construction toy elements 10 are added to the structure one set at a time. The alignment tray 132 is removed from the assembler 100 and the set of construction toy elements 10 is mounted on the mounting projections 148 in a desired configuration.

The building process for structures made from the construction toy elements 10 via the assembler 100 can be shared via recipes. The recipes include ordered steps, each step calling for a set of one or more construction toy elements 10 to be mounted on the mounting projections 148 of the alignment tray 132 in a particular configuration. By following the recipe, a person can recreate the structure.

Figure 11:
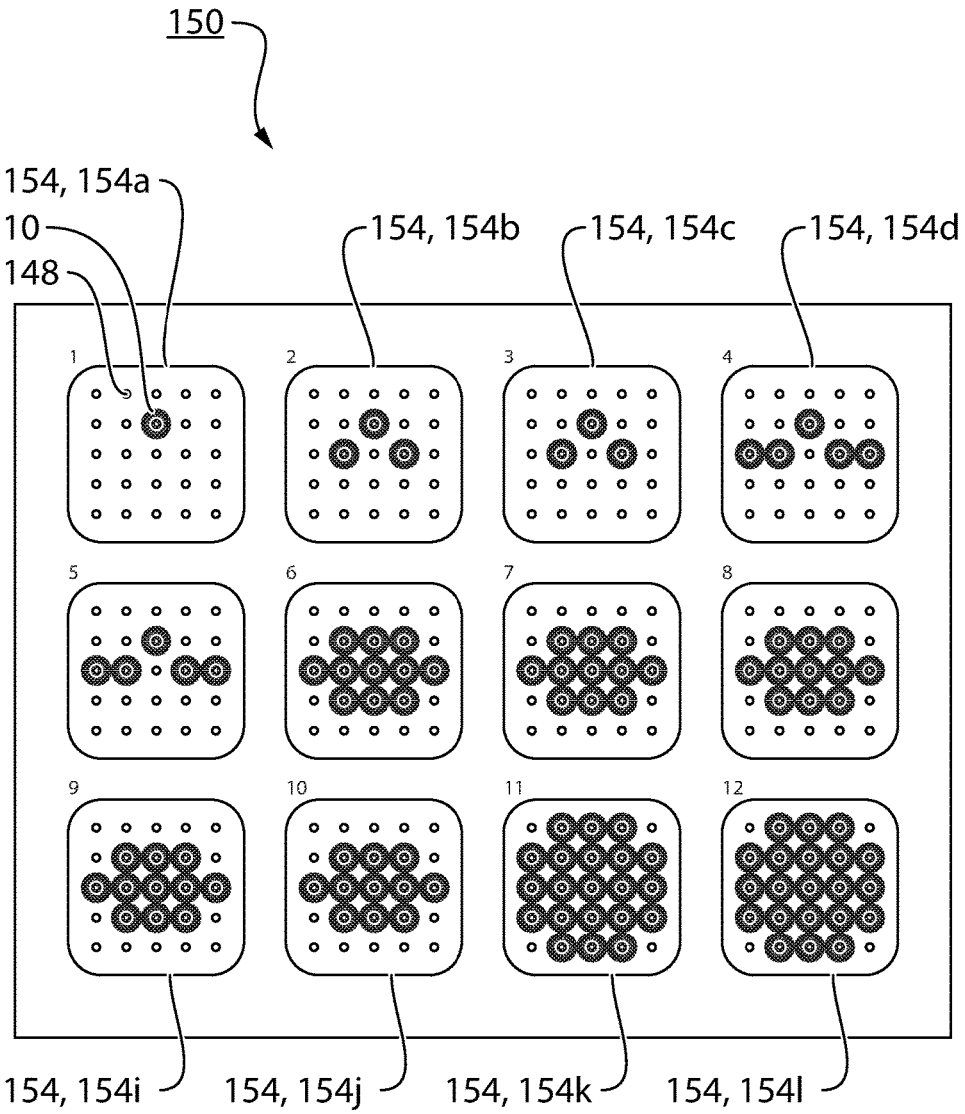
FIG. 11 shows a recipe for building a structure using the assembler of FIGS. 1 to 10.

FIG. 11 shows an exemplary recipe 150 for building a structure from the construction toy elements 10 via the assembler 100. The recipe 150 includes twelve steps 154. Each step 154 is numbered to facilitate following of the instructions 150, and shows a top plan view of the alignment tray 132 showing the five rows and five columns of mounting projections 148 thereof. As shown, in a first step 154*a*, a first construction toy element 10 is to be placed in the middle of the second row. In a second and third steps 154*b* and 154*c*, three construction toy elements 10 are to be placed on the mounting projections 148 as shown. In a fourth step 154*d* and a fifth step 154, five construction toy elements 10 are to be placed on the mounting projections 148 as shown. Later, in a ninth and a tenth step 154*i* and 154*j*, eleven construction toy elements 10 are to be placed on the mounting projections 148 as shown. In an eleventh and a twelfth step 154*k* and 154*l*, 21 construction toy elements 10 are to be placed on the mounting projections 148 as shown.

It will be understood that the recipes can specify that certain colored construction toy elements 10 be placed in certain positions on the alignment tray 132. This allows the appearance of the final structure to be controlled.

As will be appreciated, construction toy elements 10 placed in certain positions on the alignment tray 132 will push construction toy elements 10 previously placed in those positions further along the passageways 176 of the set of element conduits 172. If a construction toy element 10 is placed in a certain position on the alignment tray 132 at one step, then no construction toy element 10 is placed in the same position at the next step, the construction toy elements 10 previously inserted into the corresponding passageway 176 may not be pushed further into the passageway 176 towards the output opening 184 until either another construction toy element 10 is placed in the same position on the alignment tray 132 at a later recipe step. As a result, the appearance of the final structure can be can be somewhat obfuscated by designing the recipe steps so that the construction toy elements 10 to be placed in the positions do not necessarily end up adjacent one another in the final structure.

If sufficient sets of construction toy elements 10 are added to a structure, the chains of construction toy elements 10 are urged through the set of element conduits 172 and out of the output openings 184. As the construction toy elements 10 exit the set of element conduits 172, they are in sufficient proximity to one another to enable the hooks 32 on their arms 16 to engage the hooks 32 on the arms 16 of construction toy elements 10 exiting adjacent passageways 176. The tapering of the set of element conduits 172 places the exiting construction toy elements 10 in closer proximity to one another, thereby facilitating binding between the chains of construction toy elements 10 from adjacent passageways 176. In this manner, the construction toy elements 10 are not only bound to other construction toy elements 10 from the same passageway 176, but also bind laterally to construction toy elements 10 from adjacent passageways 176, creating a unitary structure.

Pulling the exited construction toy elements 10 from the set of element conduits 172 can extract the other bound construction toy elements 10 from the passageways 176. This may, in some cases, cause some of the connections between construction toy elements 10 to break, leaving some construction toy elements 10 to remain within the set of element conduits 172.

Figure 12:
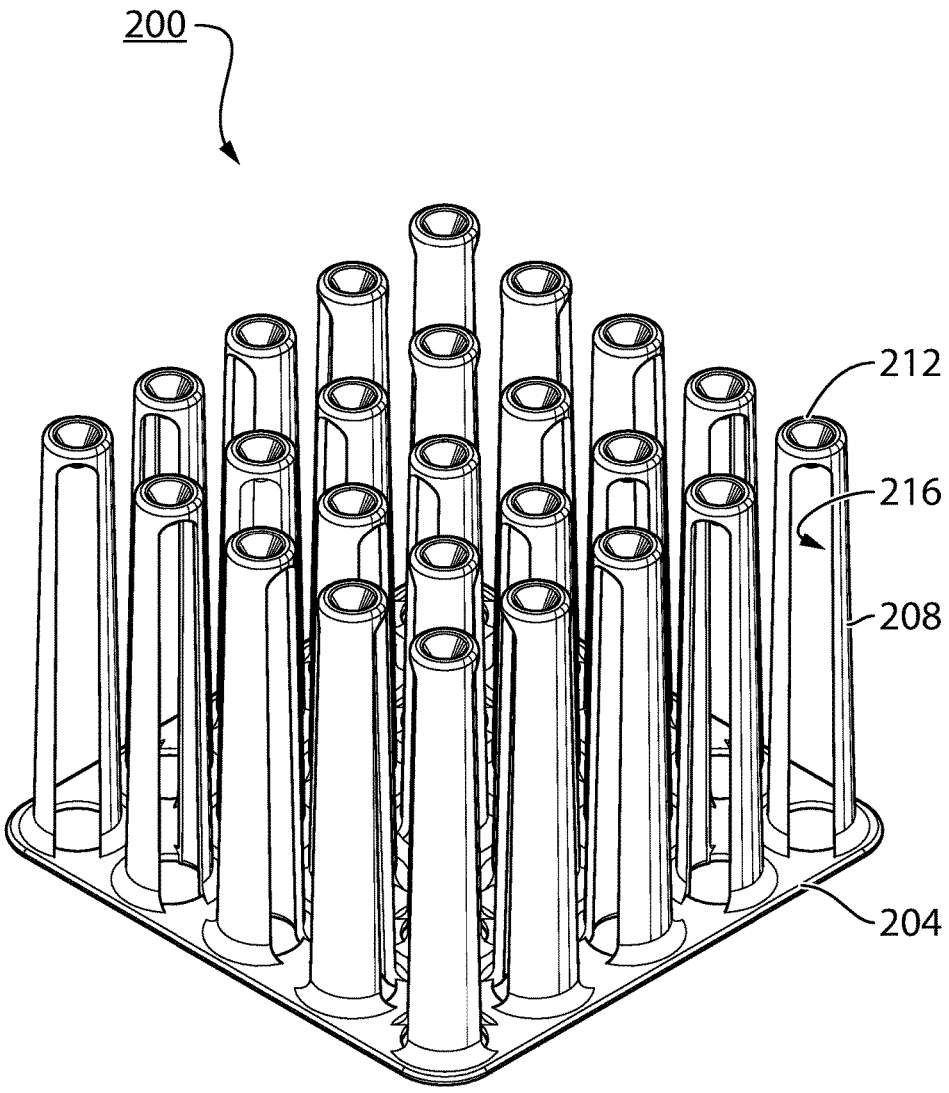
FIG. 12 is a front view of a plunger panel for use with the assembler of FIG. 7.

FIG. 12 shows a plunger panel 200 that is employed with the assembler 100 of FIG. 7. The plunger panel 200 includes a base plate 204 from which a set of plungers 208 project upwardly. Each plunger 208 corresponds to a separate passageway 176 in the set of element conduits 172. That is, there are 25 plungers 208 arranged in five rows and five columns. Each plunger 208 has a plunger head 212 that has a top surface that is slightly concave. Side slots 216 extend along two opposite sides of the plungers 208. As will be noted, the side slots 216 are provided to enable the plungers 208 to be flexible and flex within the passageways 176, as all but the central passageway 176*a* deviates along its path through the set of element conduits 172.

Each plunger 208 is provided suitable flexibility in a direction that is perpendicular to a plane passing through the two slots 216 thereof, and is generally inflexible in directions that are normal to this plane. It is desirable for the plungers 208 to be flexible to conform to the deviated passageways 176 defined by the set of element conduits 172 while remaining sufficiently inflexible to be able to urge any construction toy elements 10 in the passageways 176 therethrough. The slots 216 are positioned within each plunger 208 depending on the direction in which flexibility of the plunger 208 is desired. Generally, in the illustrated embodiment, flexibility towards the central plunger 208 is desired, and thus the slots 216 of each plunger 208 are aligned with a plane that is normal to a vector from the plunger 208 to the central plunger 208 and passes through the center of the plunger 208. The plungers 208 are generally inflexible in directions that are parallel to the plane passing through the two slots 216 thereof.

After insertion of the final set of construction toy elements 10 within the set of element conduits 172, the assembler cap structure 108 is lifted up off of the assembler base structure 104. The construction toy elements 10 positioned within the passageways 176 of the set of element conduits 172 remain positioned therein via the force applied by the arms 16 of the construction toy elements 10 against the side walls of the passageways 172. Upon removal of the assembler cap structure 108 from the assembler base structure 104, the plunger panel 200 can be positioned atop of the alignment tray 132, with the mounting projections 148 fitting within recesses on the underside of the plungers 208 to prevent lateral slippage of the plunger panel 200 generally perpendicular to the central projection axes $A_P$ of the mounting posts 148. Once the plunger panel 200 is positioned atop of the alignment tray 132, the assembler cap structure 108 is repositioned atop of the assembler base structure 104 and inserted thereon, with the plunger heads 212 aligning with the receiving openings 180 of the passageways 172. As at least one of the construction toy elements 10 lodged within the passageways 172 is positioned adjacent the receiving opening 180, it abuts against the plunger cap 212 and inhibits the assembler cap structure 208 from casually slipping downwards and closer to the assembler base structure 104.

Figure 13:
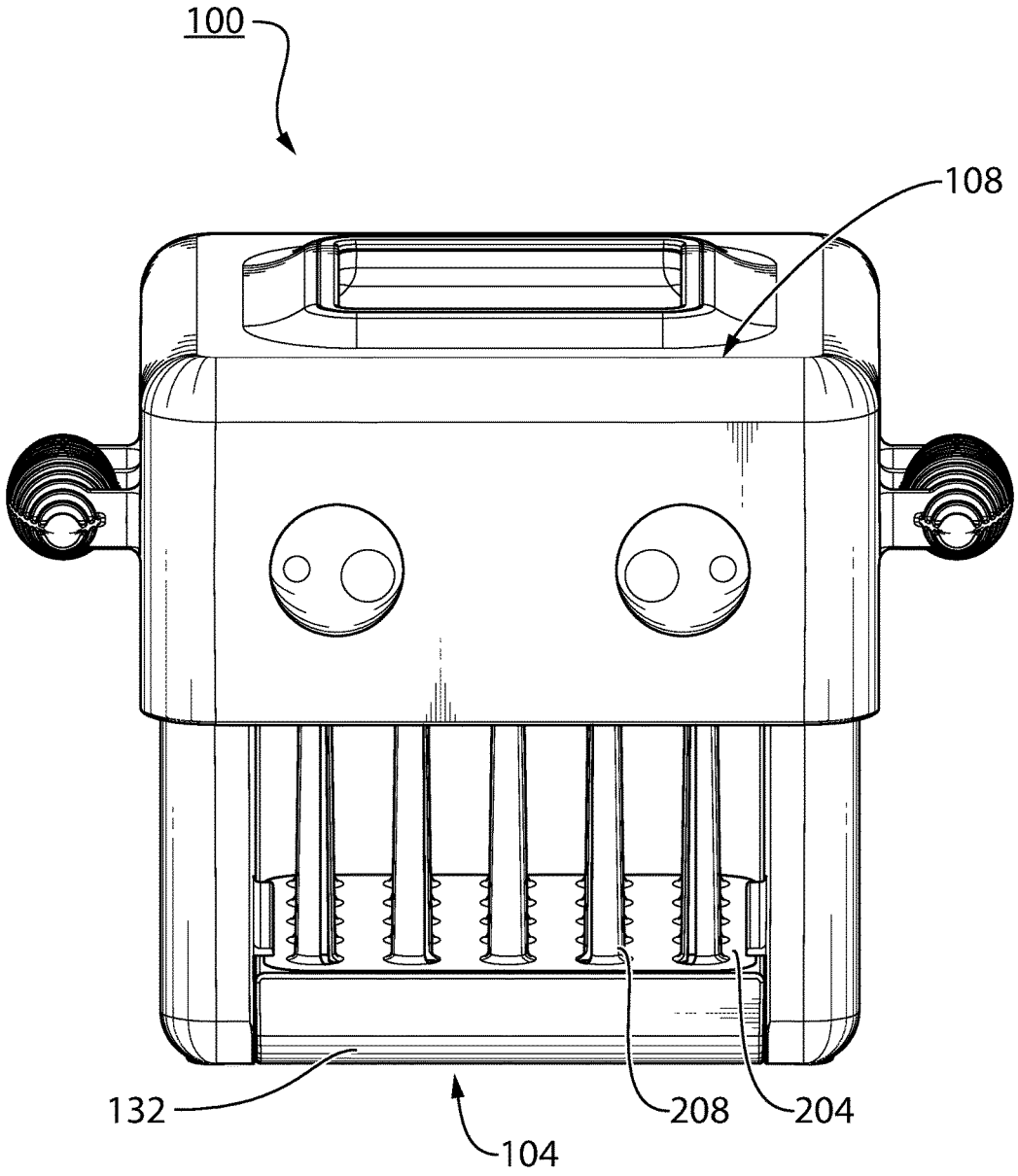
FIG. 13 is a front view of the assembler of FIG. 7 with the plunger panel of FIG. 10 placed atop of the alignment tray.

FIG. 13 shows the assembler 100 after insertion of the plunger panel 200 and re-placement of the assembler cap structure 108 atop of the assembler base structure 104. As can be seen, the length of the plungers 208 inhibits the assembler cap structure 108 from further travel towards the assembler base structure 104 and remains in a higher position than when the plunger panel 200 is not present in the assembler 100.

The assembler cap structure 108 and the assembler base structure 104 are then moved relative to one another to the second pose, thereby urging the plungers 208 to travel through the passageways 176 towards the output openings 184. As the plungers 208 travel through the passageways 176, any construction toy elements 10 positioned therein are urged through the passageways 176 towards the output openings 184 by contact of the plunger heads 200. The chains of construction toy elements 10 from each passageway 176 can then be manually grasped and pulled out from the passageways 176, and compressed to cause the construction toy elements 10 of the structure to bind further.

Figure 14:
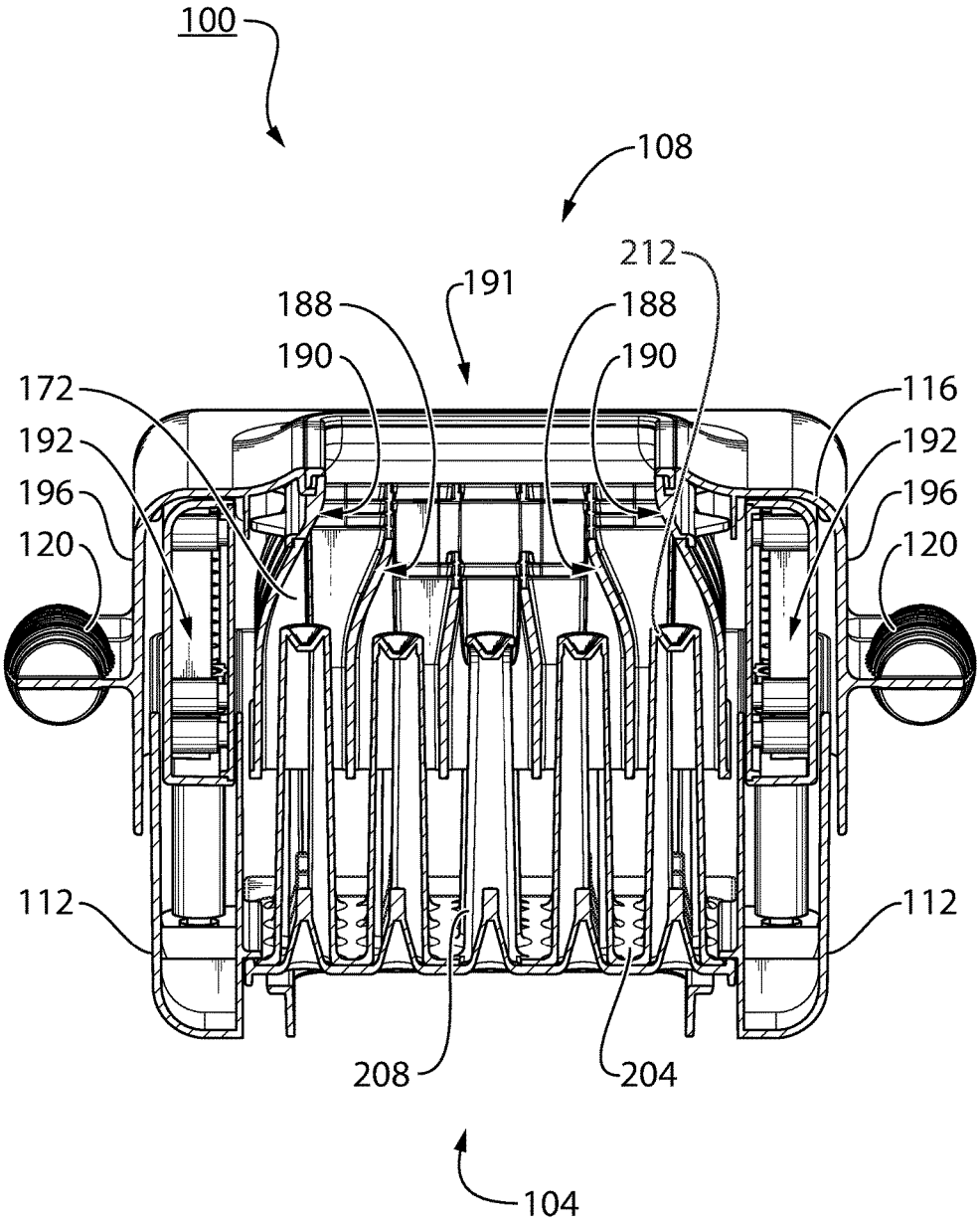
FIG. 14 is a front view of the assembler of FIG. 7 with the plunger panel of FIG. 10 placed atop of the alignment tray.

FIG. 14 shows the position of the plungers 208 after moving the assembler cap structure 108 and the assembler base structure 104 partially towards the second pose.

Figure 15:
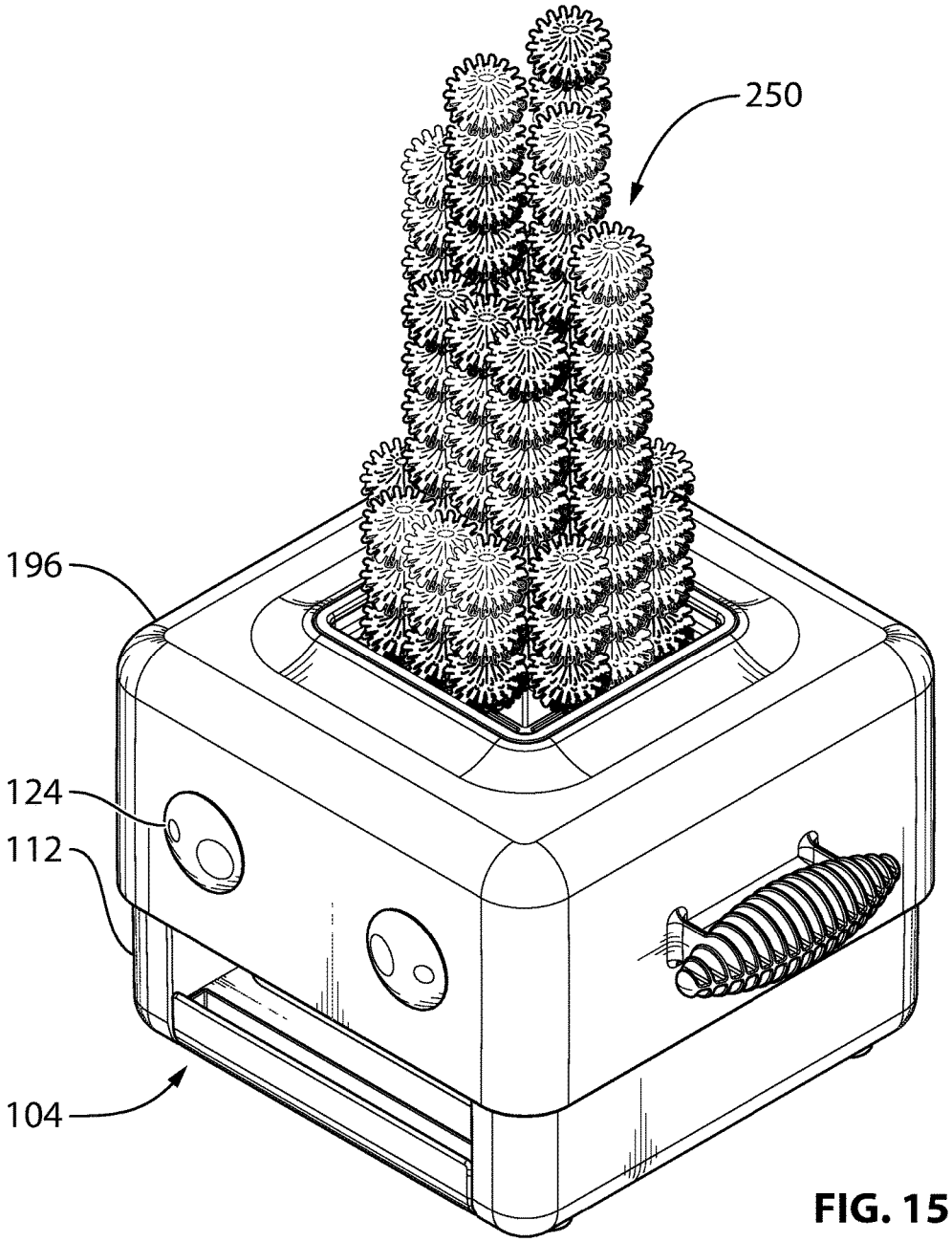
FIG. 15 shows a structure built from the construction toy elements of FIGS. 1 to 5 being urged out of the assembler of FIGS. 7 to 14.

FIG. 15 shows the set of element conduits 172 and the alignment tray 132 being moved to the second pose by a user, with the construction toy elements 10 exiting the assembler 100 forming a structure 250. The length of the plungers 208 is selected to urge the construction toy elements 10 almost entirely out of the passageways 176 so that they can be easily grasped and withdrawn manually by a user. Alternatively, the length of the plungers 208 can be selected to urge the construction toy elements 10 entirely out of the passageways 176.

Upon removal of the construction toy elements 10 from the assembler 100, the plunger panel 200 can be removed by lifting the assembler cap structure 108 up off of the assembler base structure 104 to separate them, and then lifting the plunger panel 200 off of the alignment tray 132. The assembler cap structure 108 can then be placed again over the assembler base structure 104, nesting the side walls 112 of the assembly base structure 104 within the cavities 192 of the side walls 196 of the crown 116.

Figure 16:
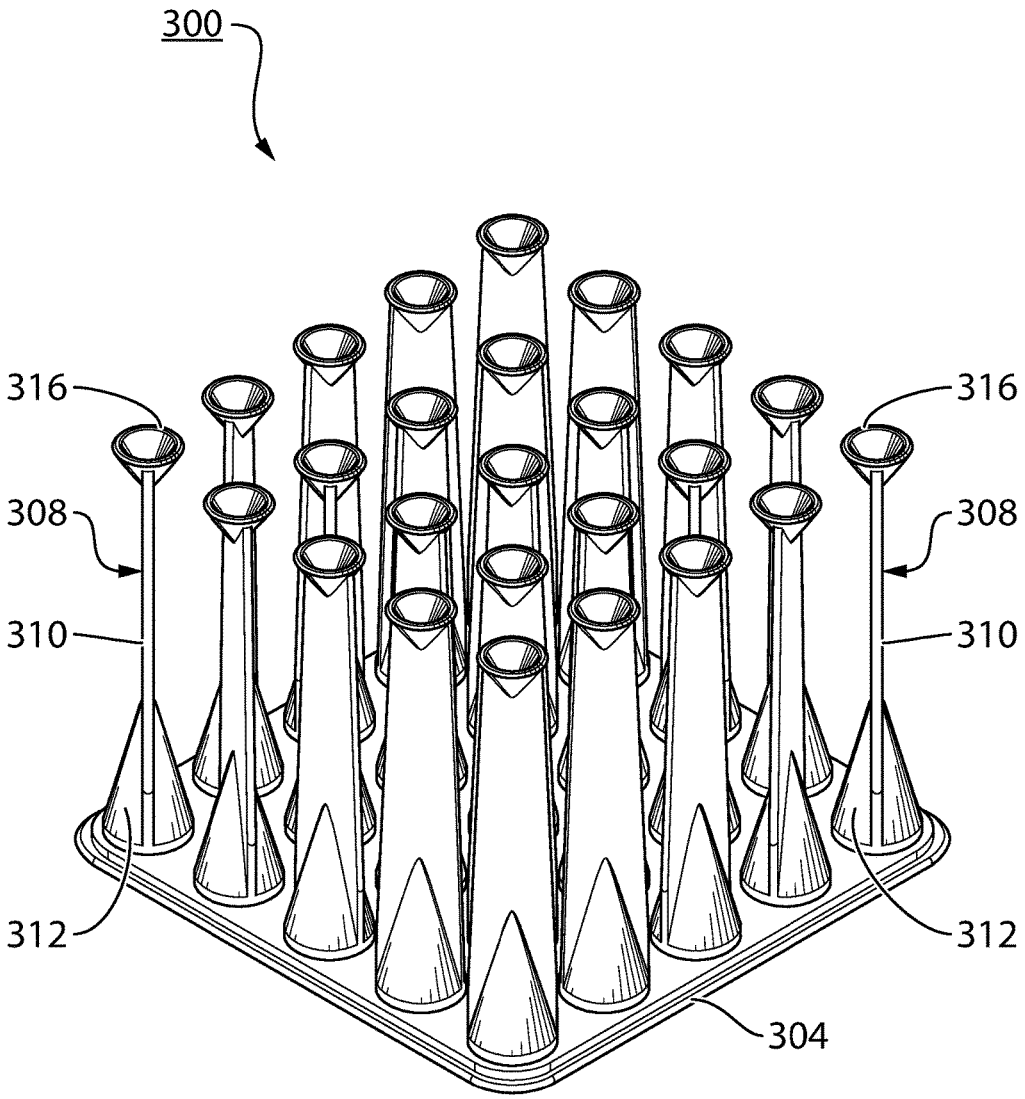
FIG. 16 shows a perspective view of a plunger panel in accordance with another embodiment for use with the assembler of FIGS. 1 to 10.

FIG. 16 shows a plunger panel 300 in accordance with another embodiment that can be employed with the assembler 100 of FIGS. 1 to 10. The plunger panel 300 includes a base plate 304 from which a set of plungers 308 project upwardly. There are 25 plungers 308 arranged in five rows and five columns. Each plunger 308 has an elongated planar body 310 that extends from a generally conical base 312. The elongated planar body 310 terminated at a plunger head 316 that has a top surface that is slightly concave.

Each plunger 308 is flexible in directions that are generally normal to the plane of the elongated planar body 310, and is generally inflexible in directions that are generally parallel to the plane of the elongated planar body 310. It is desirable for the plungers 308 to be flexible to conform to the deviated passageways 176 defined by the set of element conduits 172 while remaining sufficiently inflexible to be able to urge any construction toy elements 10 in the passageways 176 therethrough. The angular orientation at which the elongated planar body 310 of each plunger 308 extends from the respective generally conical base 312 corresponds to the direction in which flexibility of the plunger 308 is desired. Generally, in the illustrated embodiment, flexibility towards the central plunger 308 is desired, and thus the elongated planar bodies 310 extend generally perpendicularly to a virtual line drawn from the center of the plungers 308 to the central plunger 308. This enables the plungers 308 to flex towards the central plunger 308 as they are deviated by the set of element conduits 172.

Other types of alignment receptacles can be employed. The alignment receptacle can be other than a planar tray in some scenarios. For example, a first position on the alignment receptacle can be at a different elevation than an adjacent position.

The alignment structures can be any structures that inhibit movement of construction toy elements to other positions. In one alternative embodiment, the alignment structures can be a set of posts between which the body a construction toy element can be positioned.

The alignment structures can be separation structures preventing contact between the first connecting member of one of the construction toy elements placed in one of the positions from contacting the first connecting member of another of the construction toy elements placed in an adjacent one of the positions. For example, the alignment structures can be continuous or broken wall structures limiting movement of the construction toy elements to other positions. The set of element conduits can then slide between the walls in the second pose to pick up the construction toy elements situated in the positions.

In some cases, two or more construction toy elements can occupy a single position. For example, the mounting projections can be made with a long mounting post upon which one or more construction toy elements can be mounted. When the set of element conduits is then moved to the second pose relative to the alignment tray, the one or more construction toy elements on each mounting projection can be picked up together. Similarly, where the alignment structures are walls, two or more of the construction toy elements can be placed together in each position between the walls. The set of element conduits can be accordingly sized to pick up the construction toy elements in each position. In this example, the assembler can be design so that some positions are designed for a single construction toy element, whereas other positions are designed for two or more construction toy elements.

It will be appreciated that the construction toy elements need not have apertures in their bodies in order to work with some of the alignment structures noted above.

The alignment structures can define any arrangement of positions desired. For example, the assembler can be designed so that a single row or column of positions is defined so that the structures generated are somewhat two-dimensional, such as flat images that are made with construction toy elements of different colors. The set of element conduits can be designed accordingly to match the arrangement of the alignment structures.

While all of the plungers in the plunger panel illustrated are made to be flexible via the use of side slots, only those plungers that correspond to non-linear passageways can be made flexible. Further, other manners of making the plungers flexible will occur to those skilled in the art. For example, other cutaways, apertures, and thinner walled portions can be employed to provide the plungers with flexibility. The plungers can be coil springs or made of a flexible material that can bend laterally as needed.

The set of element conduits can include engagement features to engage the arms of the construction toy elements within the passageways. For example, ridges or bumps can be provided within the passageways. In another embodiment, the engagement features can be bristles that are angled upwardly within the passageways. These engagement features can act to inhibit travel of the construction toy elements positioned within the passageways towards the receiving openings. Where such engagement features are employed, the passageway walls need not be narrower than the span of the arms of the construction toy elements.

While in the above embodiment, the motion alignment structure is coupled to both the alignment receptacle and the set of element conduits, in other embodiments, it may be coupled to one none or one of them, but can control relative movement of the alignment receptacle and the set of element conduits regardless. In one example, the motion alignment structure can be coupled to the set of element conduits that are placed atop of the alignment receptacle and limit relative lateral movement of the set of element conduits and the alignment receptacle by corresponding engaging features.

Persons skilled in the art will appreciate that there are yet more alternative implementations and modifications possible, and that the above examples are only illustrations of one or more implementations. The scope, therefore, is only to be limited by the claims appended hereto.

The invention claimed is:

1. An assembler for construction toy structures assembled from construction toy elements, each construction toy element having a plurality of arms extending from a body, wherein each arm includes a root end projecting from the body and a free end having a first connecting member thereon that is configured for connecting the construction toy element to another construction toy element, comprising:

an alignment receptacle having a set of alignment structures defining positions along the alignment receptacle, each of the alignment structures receiving at least one of the construction toy elements and inhibiting movement thereof to other positions along the alignment receptacle;

a set of element conduits, each of the element conduits having a receiving opening securely receiving the at least one of the construction toy elements from a corresponding one of the positions along the alignment receptacle; and a motion alignment structure controlling relative movement of the set of element conduits and the alignment receptacle between a first pose, in which the receiving openings of the element conduits are spaced from the alignment receptacle, and a second pose, in which each of the receiving openings of the element conduits are situated adjacent a corresponding one of the positions of the alignment receptacle to securely receive the at least one construction toy element located at the corresponding one position.

2. An assembler according to claim 1, wherein the alignment receptacle is generally planar.

3. An assembler according to claim 1, wherein the body of each construction toy element comprises a receiving aperture, and wherein each of the alignment structures comprises a mounting projection dimensioned to slidingly fit within the aperture.

4. An assembler according to claim 1, wherein the alignment structures comprise separation structures preventing contact between the first connecting member of one of the construction toy elements placed in one of the positions from contacting the first connecting member of another of the construction toy elements placed in an adjacent one of the positions.

5. An assembler according to claim 4, wherein the separation structures comprise walls between the positions.

6. An assembler according to claim 1, wherein each of the set of element conduits has a passageway extending from the receiving opening to an output opening.

7. An assembler according to claim 6, wherein the output openings of adjacent element conduits are proximate one another so that the first connecting members of a first of the construction toy elements exiting one output opening can engage the first connecting members of an adjacent one of the output openings.

8. An assembler according to claim 7, wherein a first of the passageways tapers from the receiving opening to the output opening.

9. An assembler according to claim 8, wherein a second of the passageways adjacent the tapered passageway is non-linear and veers towards the first passageway proximal to the output opening thereof.

10. An assembler according to claim 9, where the side wall of a third of the passageways extends downstream of the output opening of the second passageway and slopes towards a central axis of the first passageway.

11. An assembler according to claim 6, wherein a first of the passageways is non-linear and veers towards a second of the passageways proximal to the output opening thereof.

12. An assembler according to claim 11, where the side wall of a third of the passageways extends downstream of the output opening of the first passageway and slopes towards a central axis of the second passageway.

13. An assembler according to claim 6, further comprising a connected set of plungers insertable between the alignment receptacle and the set of element conduits, the plungers being dimensioned to at least partially travel into the element conduits when the set of element conduits and the alignment receptacle are moved relative to one another towards the second pose.

14. An assembler according to claim 13, wherein the passageway of at least one of the element conduits is non-linear, and wherein at least one of the plungers corresponding to the at least one element conduit with the non-linear passageway is suitably flexible to travel through the passageways of the at least one element conduit.

15. An assembler according to claim 6, wherein the passageways adjacent the receiving openings are smaller in width than a span of the arms of the construction toy elements so that the arms of the construction toy elements hold the construction toy elements within the passageways.

16. An assembler according to claim 6, wherein the element conduits comprise engagement features within the passageways of the element conduits engaging the arms of the construction toy elements placed therein.

17. An assembler according to claim 16, wherein the engagement features inhibit travel of the construction toy elements positioned within the passageways towards the receiving openings.

* * * * *